US005650594A

United States Patent [19]

Urnovitz

[11] Patent Number: 5,650,594

[45] Date of Patent: Jul. 22, 1997

[54] INSULATED ANIMAL GUARD FOR ELECTRICAL TRANSFORMERS

[76] Inventor: Leslie A. Urnovitz, 4639 Allum Rd., Houston, Tex. 77045

[21] Appl. No.: 431,450

[22] Filed: May 1, 1995

[51] Int. Cl.[6] ..... H01B 17/00

[52] U.S. Cl. ..... 174/139; 52/101; 49/58

[58] Field of Search ..... 174/5 R, 139, 174/137 R, 138 E, 138 F, 138 G, 138 R, 135; 336/192; 52/101; 47/23, 24; 49/58, 59; 361/232

[56] References Cited

U.S. PATENT DOCUMENTS

| | | | |
|---|---|---|---|
| 422,651 | 3/1890 | Stanley | 174/175 X |
| 5,359,313 | 10/1994 | Watanabe et al. | 336/192 X |

OTHER PUBLICATIONS

McGraw, "Joint Effort yields new barrier design", Electrical World, Jan. 1985, pp. 85–86.

"The Squirrely", HJ Arnett Industries, Inc. Dec. 16, 1986, 2 pages.

*Primary Examiner*—Hyung S. Sough

*Attorney, Agent, or Firm*—Kenneth A. Roddy

[57] ABSTRACT

An insulated animal guard device for installation on electrical transformers to prevent animals climbing or perching on the transformer from causing a short circuit between the transformer and adjacent high voltage power lines. The device is a flat member formed of electrically non-conductive material apertured at one end to be releasably engaged on an insulated bushing extending from the upper end of the transformer to retain the device in a generally horizontal position on top of the transformer. The device is apertured at the opposite end to be received and releasably engaged on the hook jaw clamping elements at one end of a hotstick. A lineworker using a hotstick can easily position the device relative to the transformer and engage it with the insulated bushing so that the power lines and transformer need not be de-energized during installation or removal of the device.

1 Claim, 2 Drawing Sheets

INSULATED ANIMAL GUARD FOR ELECTRICAL TRANSFORMERS

BACKGROUND OF THE INVENTION

1. Field of the Invention

This invention relates generally to animal guards and electrical transformers, and more particularly to an insulated animal guard adapted to be installed on an electrical transformer to prevent animals climbing or perching thereon from causing a short circuit between the transformer and adjacent high voltage power lines.

2. Brief Description of the Prior Art

Electrical power outages caused by animals climbing or perching on electrical transformers is a common problem in the electrical utilities industry. The animal, such as a squirrel or bird climbing or perching on the transformer will sometimes contact a high voltage power line adjacent the transformer with it's tail or wing, which causes a short circuit between the power line and the transformer.

Insulated animal guard devices are known in the art which are installed on power lines or on the crossbars of utility poles to prevent animals from climbing the poles, walking along the high voltage lines or perching on the crossbars. Some of these devices rotate relative to the line or have barbs to discourage climbing, walking, and perching. However, most of these must be installed by hand at close quarters, and require that the power be shut off during installation or removal of the device.

Others have attempted to solve this problem by installing insulated devices on the transformer. One such device is marketed by Preformed Line Products of Cleveland, Ohio. This device is a flat plate made of plastic and has a slot with straight sides which extends inwardly from one side edge and terminates in a circular hole to define a keyhole-shaped slot. There is another circular hole near one corner which is merely used to hang the device when not in use. Because this device does not have any means for receiving an elongate insulated installation tool to install it on a transformer, the only way it can be installed on a transformer is for the installer, positioned at close quarters to the transformer and high voltage lines, to install it by hand, thus placing the installer's hands dangerously close to the transformer and high voltage lines. Because of these shortcomings, it requires that the power be shut down in order to safely install or remove the device.

Recently OSHA and NEC have adopted safety regulations regarding the safe working distance for persons working on high voltage power lines. The recommended minimum distance to be maintained is 2'–1" between the installer and the power line when working on installations over 600 volts.

Most prior art animal guards and insulating devices currently available such as the Preformed Line Products device are designed to be installed within reach of the installer which means they would need to be installed from arms-length plus 2'–1" from the power line or transformer and, thus, they are not particularly adapted to be installed by the installer positioned at the recommended minimum safe working distance.

The present invention is distinguished over the prior art in general by an insulated animal guard device for installation on electrical transformers to prevent animals climbing or perching on the transformer from causing a short circuit between the transformer and adjacent high voltage power lines. The device is a flat member formed of electrically non-conductive material apertured at one end to be releasably engaged on an insulated bushing extending from the upper end of the transformer to retain the device in a generally horizontal position on top of the transformer. The device is apertured at the opposite end to be received and releasably engaged on the hook jaw clamping elements at one end of a hotstick. A lineworker using a hotstick can easily position the device relative to the transformer and engage it with the insulated bushing so that the power lines and transformer need not be de-energized during installation or removal of the device.

SUMMARY OF THE INVENTION

It is therefore an object of the present invention to provide an insulated animal guard adapted to be installed on an electrical transformer to prevent animals climbing or perching thereon from causing a short circuit between the transformer and adjacent high voltage power lines.

It is another object of this invention to provide an insulated animal guard adapted to be installed on an electrical transformer from the recommended safe working distance in accordance with OSHA and NEC regulations.

Another object of this invention is to provide an insulated animal guard which is installed easily and quickly on an electrical transformer with existing insulated tools and equipment and does not require modification of the existing transformer or power lines.

Another object of this invention is to provide an insulated animal guard which has a flat portion to be supported on the top surface of an electrical transformer and apertured at one end to be received and engage the insulated bushing extending outwardly therefrom to maintain the guard on the transformer.

A further object of this invention is to provide an insulated animal guard which has a flat portion to be supported on the top surface of an electrical transformer and apertured at one end to engage the insulated bushing and apertured at the opposite end for releasable connection with the jaw of a conventional OSHA approved insulated hotstick for installing the guard on the transformer.

A still further object of this invention is to provide an insulated animal guard which simple in construction, economical to manufacture, and rugged and durable in use.

Other objects of the invention will become apparent from time to time throughout the specification and claims as hereinafter related.

The above noted objects and other objects of the invention are accomplished by an insulated animal guard device for installation on electrical transformers to prevent animals climbing or perching on the transformer from causing a short circuit between the transformer and adjacent high voltage power lines. The device is a flat member formed of electrically non-conductive material apertured at one end to be releasably engaged on an insulated bushing extending from the upper end of the transformer to retain the device in a generally horizontal position on top of the transformer. The device is apertured at the opposite end to be received and releasably engaged on the hook jaw clamping elements at one end of a hotstick. A lineworker using a hotstick can easily position the device relative to the transformer and engage it with the insulated bushing so that the power lines and transformer need not be de-energized during installation or removal of the device.

DESCRIPTION OF THE PREFERRED EMBODIMENT

Figure 2:
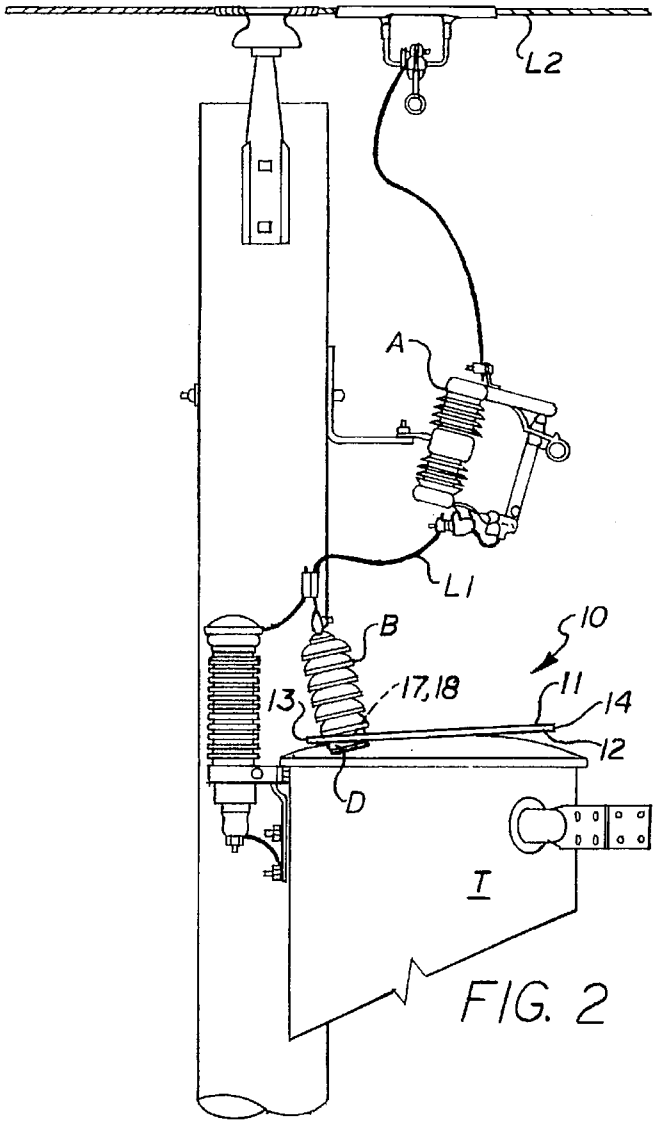
FIG. 2 is side elevation of an electrical transformer showing the insulated animal guard installed thereon.
Figure 1:
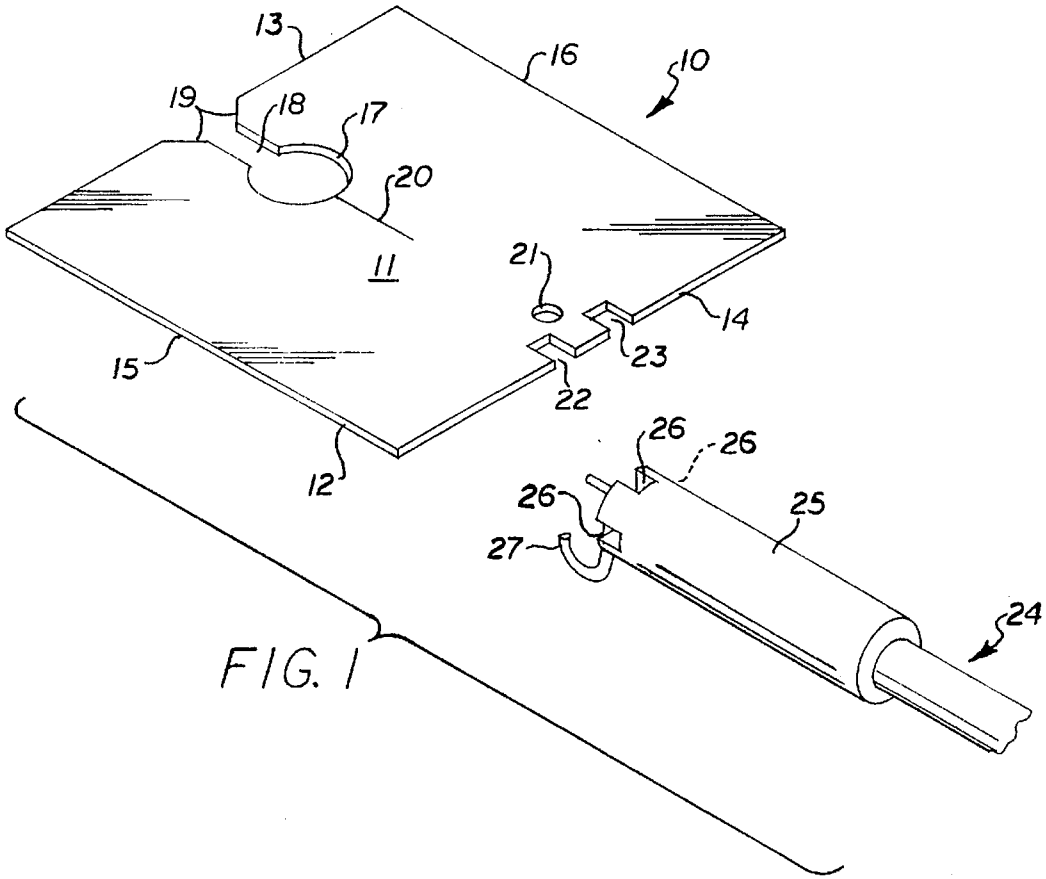
FIG. 1 is a perspective view of the insulated animal guard in accordance with the present invention shown being attached to the head of an installation tool for installing it on an electrical transformer.

Referring to the drawings by numerals of reference, there is shown in FIGS. 1 and 2, a preferred insulated animal guard 10 in accordance with the present invention. The animal guard 10 is a flat, generally square or rectangular, device formed of electrically non-conductive material having a top and bottom surfaces 11 and 12, and opposed parallel side edges 13, 14, 15, and 16, respectively.

An aperture extends through the guard 10 near one side edge 13 which is defined by a circular hole 17 of sufficient diameter to partially encircle the reduced diameter portion D of a conventional insulated transformer bushing B and an adjoining narrow slot 18 extending outwardly from the circular hole to the exterior of the side edge 13. The slot 18 is slightly smaller in width than the reduced diameter portion D of the conventional insulated transformer bushing B. The sides of the slot 18 are angled outwardly at their outer ends 19 to guide the guard 10 onto the insulated bushing B when the guard is pressed onto the insulated bushing from a lateral direction.

A narrow cut 20 may also be provided which extends from the circular hole 17 a short distance inwardly toward the center of the guard 10 to facilitate expansion of the slot 18 and hole 17 as the guard slides onto the insulated bushing B. Thus, the guard 10 when pressed laterally onto the insulated bushing B will snap onto the reduced diameter D of the insulated bushing.

An aperture extends through the guard 10 near the side edge 14 opposite the edge 13 which is defined by a circular hole 21 of sufficient diameter to receive the gripping hook or jaw member 27 at the outer end of an installation tool 24 known in the trade as a "hotstick" or "shotgun" described below. A pair of parallel laterally spaced slots 22 and 23 one at each side of the hole 21 extend a short distance inwardly from the edge 14 toward the center of the guard 10 to receive the slotted portion of the head 25 of the hotstick, as described below.

Figure 3:
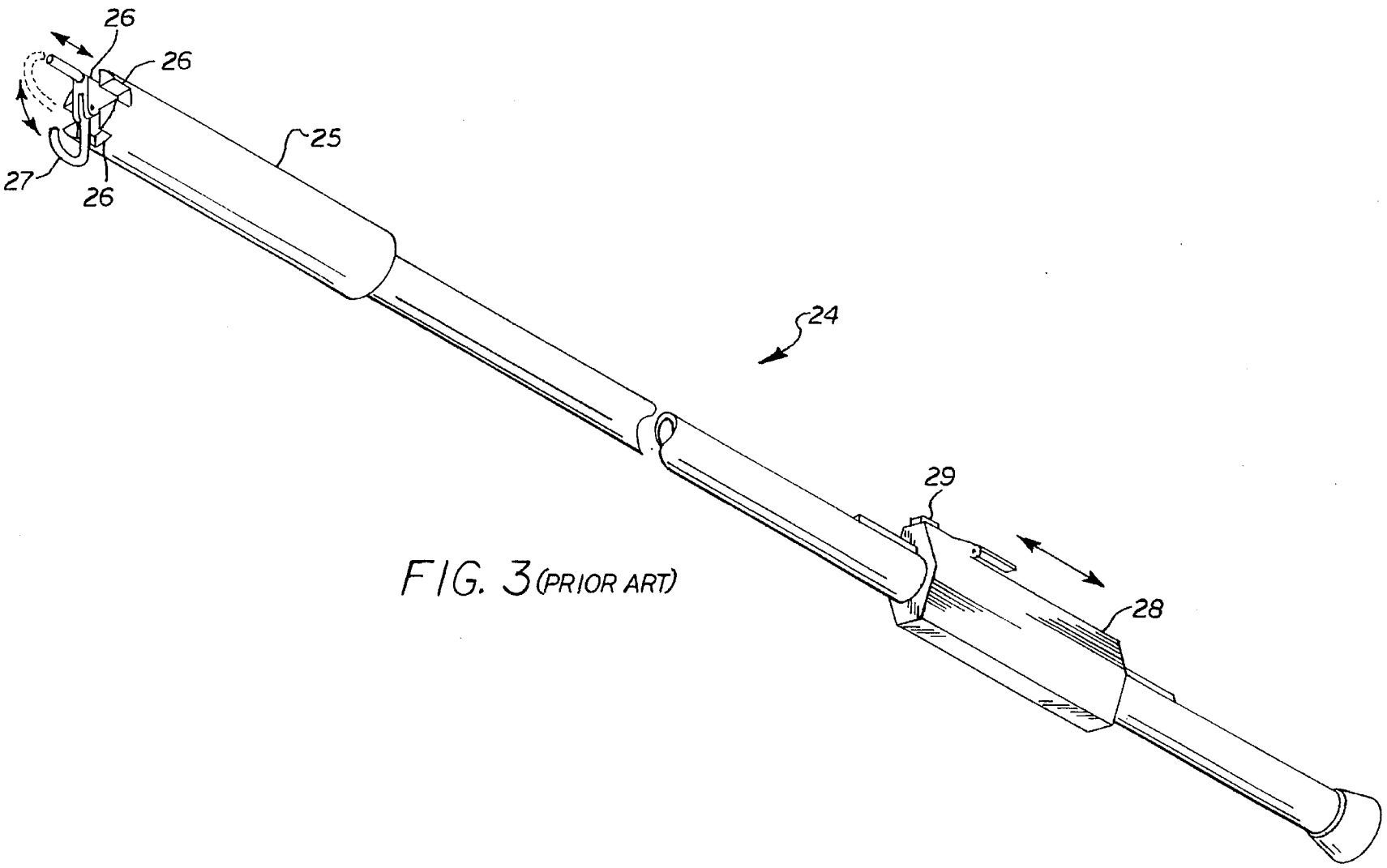
FIG. 3 (PRIOR ART)
FIG. 3 is a perspective view of a typical installation tool used for installing the insulated animal guard.

As shown in FIG. 3, the "hotstick" 24 is an elongate insulated pole or rod-like tool conventionally used by electrical utility lineworkers for installing hot-line and grounding clamps and may be provided with various end fittings. The outer end of the hotstick 24 has a tubular head 25 with diametrically opposed radial slots 26 in its side wall. A segmented hook or jaw 27 slides axially in and out of the head 25 and is operated by a sliding handle 28 at the other end of the hotstick. As it is retracted, the hook or jaw 27 closes around an object, usually a wire or the eyescrew of a grounding clamp and retracts it into the tool head 25. A safety thumb latch 29 on the handle 28 is depressed to release the locked handle so it can move forward and open the hook or jaw 27. The hook or jaw 27 and its actuator mechanism may be metal, but all parts on the outside of the hotstick are formed of electrically non-conductive material.

The hotstick allows the worker to maintain recommended safe working distances when working on electrical power lines and equipment. OSHA approved hotsticks suitable for use with the present animal guard are manufactured by Hastings Fiber Glass Products, Inc., of Hastings, Mich., and by A. B. Chance Company of Centralia, Mo.

The animal guard 10 is installed by a lineworker standing on the ground or in the bucket of a bucket truck using a hotstick 24 from a safe distance, for example eight to ten feet from the transformer. The edge 14 of the guard 10 is placed onto the open hook or jaw 27 of the hotstick 24 and the handle 28 of the hotstick is retracted. As the handle 28 is retracted, the hook or jaw 27 closes through the hole 21 and around the edge 14 of the guard 10 and pulls it toward the head 25 until the slots 22 and 23 of the guard are engaged in the laterally opposed slots 26 of the head, and the handle 28 is locked to prevent accidental opening of the jaw 27.

As shown in FIG. 2, the lineworker then places the gripped animal guard over the top end of the transformer T and pushes it toward the transformer bushing B which extends upwardly near one end of the top of the transformer T. The slot 18 of the animal guard 10 is aligned with the reduced diameter portion D of the insulated bushing B and the guard is pressed laterally onto the reduced diameter portion until the circular hole 17 snaps into place around the reduced diameter portion. The safety thumb latch 29 on the handle 28 of the hotstick 24 is depressed, the handle 28 is moved forward to open the hook or jaw 27, and the hotstick is removed from the animal guard 10.

When properly positioned, the bottom surface 12 of the insulated animal guard 10 is supported on the top surface of the transformer T and is engaged at one end on the insulated bushing B. A high voltage line L1 extends from the top of the bushing B and is connected to the main high voltage line L2, usually with a lightning arrester A connected therebetween. The line L1 extending from the transformer may carry 8,000 volts.

In most installations, the insulated animal guard 10 will be disposed in a generally horizontal plane and serves as an insulated cover or platform on the top of the transformer to prevent animals, such as squirrels which may climb onto the platform, or birds which may perch thereon from completing an electric circuit between the line L1 and the transformer T should their tail or wing contact the line and thereby causing a power outage. In some installations, the insulated animal guard 10 may be disposed at an angle relative a horizontal plane, in which case the smooth slick top surface 11 of the guard will not allow the animals to climb onto or perch thereon.

In a preferred embodiment, the animal guard 10 is formed of an electrically non-conductive material, such as a high density polyethylene copolymer plastic material. A suitable material is marketed by Solvay Polymers, Inc., of Houston, Tex. under the name Fortiflex(tm) G50-120B, and may be modified by adding an ultraviolet stabilizer.

While this invention has been described fully and completely with special emphasis upon a preferred embodiment, it should be understood that within the scope of the appended claims the invention may be practiced otherwise than as specifically described herein.

I claim:

1. An electrically insulated animal guard adapted to be installed on a top of electrical transformers to prevent animals climbing or perching on the transformer from causing a short circuit between the transformer and adjacent high voltage power lines, comprising:

a flat planar member formed of electrically non-conductive material having flat top and bottom surfaces and opposed parallel front and rear ends, said flat planer member sized and shaped to be installed and supported on a top end of an electrical transformer having an insulated bushing extending generally vertically upward adjacent to its top end;

a first circular hole near said front end extending through said flat member between said top and bottom surfaces of sufficient diameter to partially encircle a reduced diameter portion of said bushing and an adjoining slot extending outwardly from said circular hole to an exterior of said front end, said slot being slightly smaller in width than the reduced diameter portion of said bushing such that when pressed laterally onto said bushing reduced diameter portion said circular hole will snap onto said reduced diameter portion to retain said flat member on said bushing with said bottom surface resting on said top of said transformer;

said slot having lateral sides which are angled outwardly at their juncture with said front end to facilitate entry of said slot onto said bushing reduced diameter portion when pressed thereon from a lateral direction;

a narrow cut in said flat member extending from said first circular hole a short distance inwardly toward the center of said flat member to facilitate lateral expansion of said slot and said circular hole as it snaps onto said bushing reduced diameter portion;

a smaller second circular hole disposed a distance inwardly from said rear end extending through said flat member between said top and bottom surfaces, said second hole being of sufficient diameter to releasably receive a closable jaw hook element at a head end of an elongate insulated installation pole; and a pair of parallel laterally spaced slots, one at each side of said second hole, extending a short distance inwardly from said rear end, said slots being of sufficient size to receive mating slotted elements at said head end of said insulated installation pole.

* * * * *